United States Patent [19]

Hahn

[11] 4,286,410

[45] Sep. 1, 1981

[54] ASSEMBLY FOR WEATHER-SEALING A JOINT

[75] Inventor: Norbert Hahn, Cudahy, Wis.

[73] Assignee: Rite-Hite Corporation, Milwaukee, Wis.

[21] Appl. No.: 101,779

[22] Filed: Dec. 10, 1979

[51] Int. Cl.[3] ..... E06B 7/00

[52] U.S. Cl. ..... 49/33; 49/488; 49/489; 404/68; 404/47; 14/71.3; 52/402

[58] Field of Search ..... 14/71.1, 71.3; 404/47, 404/68, 65, 69; 52/401, 402; 49/488, 489, 33, 470

[56] References Cited

U.S. PATENT DOCUMENTS

| | | | |
|---|---|---|---|
| 1,024,059 | 4/1912 | Brintnall | 49/33 |
| 1,337,394 | 4/1920 | Dillingham | 49/489 |
| 1,560,097 | 11/1925 | Petersen | 49/470 X |
| 1,787,169 | 12/1930 | Roberts | 49/489 X |
| 2,132,060 | 10/1938 | Tremblay | 49/489 |
| 2,198,084 | 4/1940 | Jacobson | 404/69 |
| 2,528,264 | 10/1950 | Coppock | 49/489 |
| 2,751,615 | 6/1956 | Kelley | 14/71.3 |
| 2,790,213 | 4/1957 | Smith | 49/489 X |
| 2,793,070 | 5/1957 | Wernig | 49/489 X |
| 3,238,573 | 3/1966 | Pease | 49/489 X |
| 3,308,497 | 3/1967 | Lambert | 14/71.3 |
| 3,535,824 | 10/1970 | Kessler | 49/489 X |
| 3,886,615 | 6/1975 | Metro | 14/71.3 |

*Primary Examiner*—Nile C. Byers, Jr.

*Attorney, Agent, or Firm*—Neuman, Williams Anderson & Olson

[57] ABSTRACT

An assembly is provided for weather-sealing an elongated joint formed between a first member and a second member when said members are disposed at a predetermined relative position. The assembly includes an elongated piece having elongated interconnected first and second sections extending angularly relative to one another. The piece is removably carried by an elongated bracket fixedly secured to a side of one of the members defining the joint. The bracket is provided with an inner wall section, an outer wall section in spaced substantially face-to-face relation with the inner wall section, and a bridge section interconnecting a pair of corresponding elongated edges of the wall sections. The wall and bridge sections coact to form an elongated pocket having a first opening at one end. Corresponding second elongated edge portions of the inner and outer wall sections are disposed in spaced relation and define an elongated second opening having an end terminating at the first opening. The elongated first section is disposed within the bracket pocket and is inserted therein and removed therefrom only upon endwise movement of the first section through the first opening. When the first section is accommodated within the bracket pocket, it is substantially impassable with respect to the bracket second opening. The second section is adapted to span the joint when the members are disposed in the predetermined relative position and is in resilient sealing engagement with the side of the other member defining the joint.

7 Claims, 6 Drawing Figures

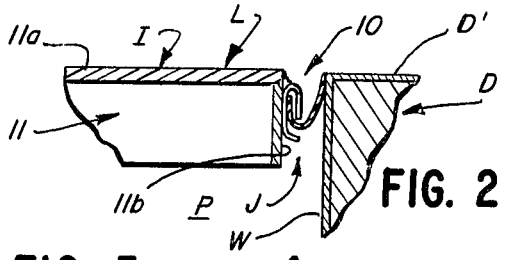
FIG. 2
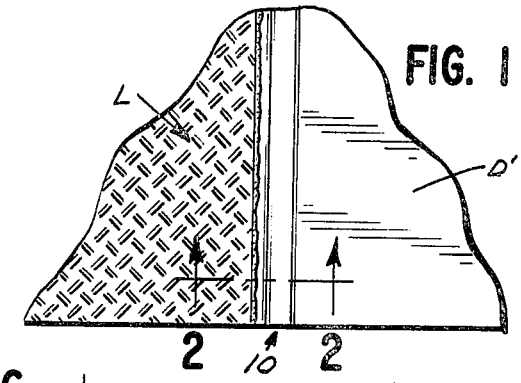
FIG. 1
FIG. 3
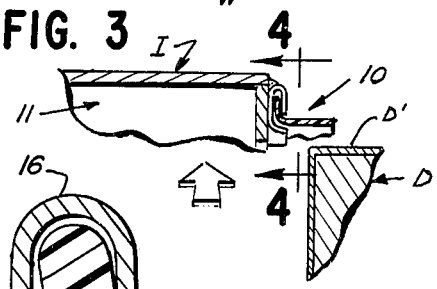
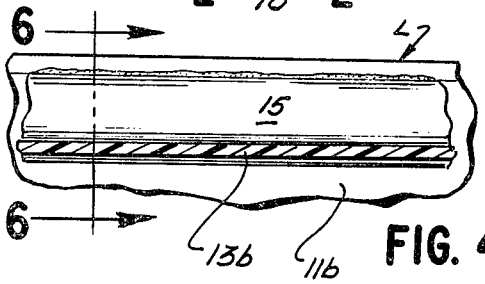
FIG. 4
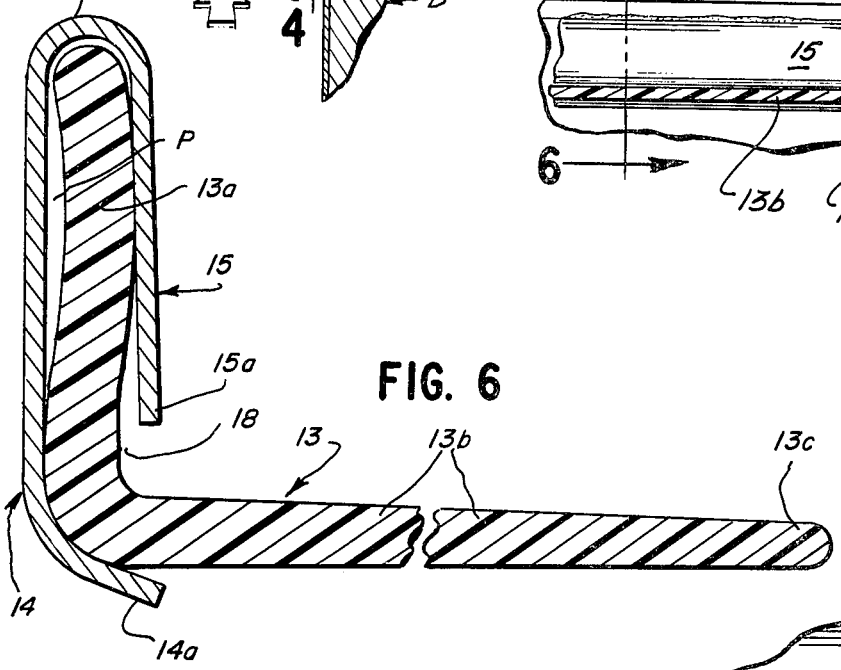
FIG. 6
FIG. 5
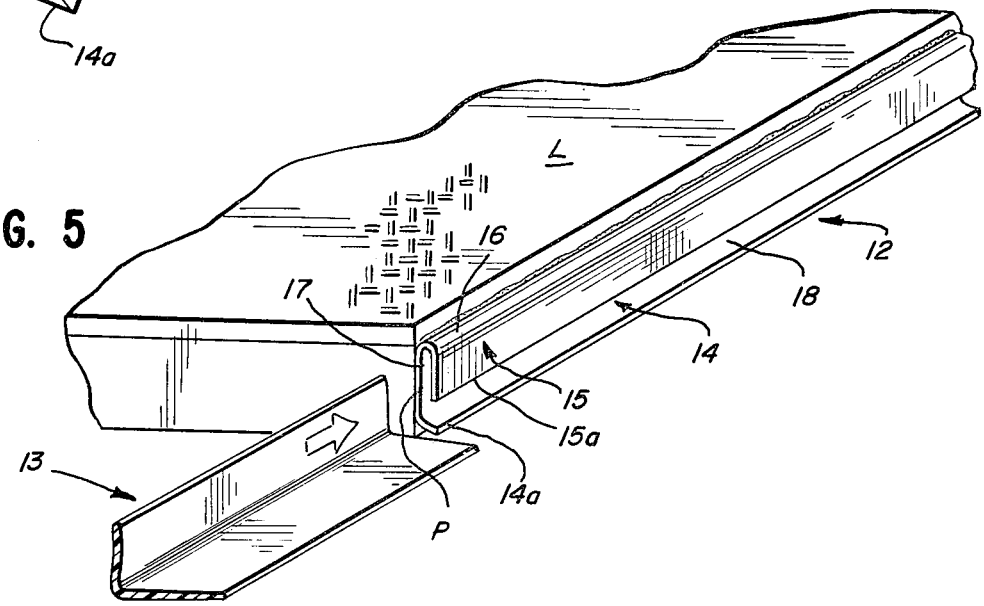

ASSEMBLY FOR WEATHER-SEALING A JOINT

BACKGROUND OF THE INVENTION

Weather-sealing of joints exposed to changeable outside climatic conditions has always been an important factor in efficiently obtaining and maintaining proper temperature control within a building. Where the building in question is a commercial or industrial type which is provided with a loading dock utilizing dock leveler equipment and the like, the temperature control problem oftentimes becomes more acute. Normally the dock leveler as a unit is mounted within a pit or recess formed in the loading dock itself. The dock leveler embodies a deck member, which is normally pivotally connected at its rear edge to a frame disposed within the pit, and when not in use, assumes a horizontal position wherein the exposed surface of the deck member is coplanar with the adjacent exposed surface of the dock. Thus, when the deck member is in such a position and loading and unloading operations are occurring on the dock, forklift trucks and the like may safely pass over the exposed surfaces of the deck member and the dock without difficulty. When the dock is not in use, the deck member also assumes the horizontal position.

Oftentimes, a portion of the pit and the associated portions of the dock leveler extend into the interior of the building even when the access door between the loading dock and the building interior is closed. It is in this latter situation wherein annoying drafts or excessive heat losses are created unless some type of weather sealing is utilized between the dock leveler and the wall surfaces of the pit in which the leveler is mounted.

Various types of weather sealing for this purpose have heretofore been proposed, however, because of certain inherent design characteristics they have been beset with one or more of the following shortcomings: (a) it was awkward and difficult to replace certain components when required; (b) the useful and effective life of these components was inordinately short, thereby requiring frequent shut down of the dock leveler; (c) it was of costly and complex construction and was ineffective in facilitating proper temperature control within the building interior; and (d) various components were adversely affected by changes in climatic conditions.

SUMMARY OF THE INVENTION

Thus, it is an object of the present invention to provide a weather-sealing assembly which avoids the aforenoted shortcomings of the prior art.

It is a further object of the present invention to provide a weather-sealing assembly which is of simple, inexpensive construction, and the replacement of a component thereof may be readily accomplished without the need for tools and with the expenditure of a minimum amount of manual effort.

It is a still further object to provide a weather-sealing assembly which may be attached to new dock leveler equipment prior to the latter being installed in place, or to old dock leveler equipment which is already installed and presently in use.

It is a still further object of the invention to provide a weather-sealing assembly capable of being attached to dock leveler equipment which varies in size and configuration over a wide range.

It is also an object to provide a weather-sealing assembly which in no way interferes with the operation of the dock leveler equipment.

Further and additional objects will appear from the description accompanying drawings and appended claims.

In accordance with one embodiment of the invention, an assembly for weather-sealing an elongated joint is provided. The joint in question is formed by first and second members when the latter are disposed in a predetermined relative position. One of the members is movable relative to the other in a plane which is substantially parallel to the resulting joint and transversely of the other member. The assembly includes an elongated piece having elongated first and second sections interconnected and angularly disposed relative to one another. An elongated bracket is fixedly secured to one of the members and accommodates the elongated piece. The bracket is provided with an elongated inner wall section secured to a side of one of the members which defines one side of the joint. In addition to the inner wall section, the bracket includes an outer wall section which is disposed in a spaced, face-to-face relation with the inner wall section. One pair of corresponding elongated edge portions of the wall sections are interconnected by a bridge section. The wall and bridge sections coact to form an elongated pocket open at one end. A second, or opposite, pair of corresponding elongated edge portions of the wall sections are disposed in spaced relation and form an elongated narrow second opening having one end thereof terminating at the first opening. The pocket formed in the bracket removably accommodates the first section of the elongated piece and the second section of the piece projects outwardly through the second opening. The projecting second section spans the joint, when the first and second members are in the predetermined relative position, and the outer distal edge portion of the piece second section is flexible and resiliently and sealingly engages the side of the other member forming the joint. When the first section of the elongated piece is accommodated within the bracket pocket, the first section can only be removed from the pocket by the first section being moved endwise out through the bracket first opening.

DESCRIPTION

For a more complete understanding of the invention reference should be made to the drawing wherein:

FIG. 1 is a fragmentary top plan view of a typical loading dock showing the deck member of a dock leveler in a horizontally disposed position and with one form of the weather-sealing assembly positioned within a joint formed by a side of the deck member and a side wall of a pit in which the dock leveler is located.

FIG. 2 is a fragmentary sectional view taken along line 2—2 of FIG. 1.

FIG. 3 is like FIG. 2, but showing the deck member in a raised position and the weather-sealing assembly disengaged from the joint-forming side wall of the pit.

FIG. 4 is an enlarged fragmentary sectional view taken along line 4—4 of FIG. 3.

FIG. 5 is an enlarged fragmentary perspective view showing the elongated piece being inserted into the bracket pocket through the first opening.

FIG. 6 is an enlarged fragmentary sectional view taken along line 6—6 of FIG. 4.

Referring now to FIGS. 1, 2, and 5, one form of an improved weather-sealing assembly 10 is shown utilized in combination with a dock leveler L mounted within a pit or recess P formed in a loading dock D.

The dock leveler L is of a type in common use in loading dock installations and functions so as to compensate for height differentials which frequently occur between the supporting surface of the loading dock and the bed of the parked vehicle during loading or unloading of the latter. The dock leveler L per se forms no part of the invention hereinafter described, but is merely for use in disclosing one application of the improved weather-sealing assembly. The dock leveler L normally includes a deck member 11 of square or rectangular configuration. The configuration of the deck member 11 will depend upon the shape and size of the pit P formed in the loading dock. The top and front of the pit are open and the opposite sides thereof are defined by vertical walls W. The rear, or inner edge portion of the deck member is hingedly connected to a frame, not shown, which is anchored in place within the pit. The top surface 11a of the deck member 11 is planar and substantially conforms to the shape and size of the open top of the pit.

When the loading dock is not in use, the deck member 11 normally assumes a horizontal position I, see FIG. 2, wherein the exposed top surface 11*a* of the deck member is coplanar with the supporting surface D' of the loading dock. When deck member 11 is in position I, the side edge portion 11*b* of the deck member and the adjacent side wall W of the pit P form an elongated joint J which extends from the open front of the pit to the back wall, not shown, of the pit. A similar joint, not shown, is formed adjacent the opposite side edge portion of the deck member.

When the dock leveler L is being adjusted to accommodate the bed of a parked vehicle, not shown, the deck member 11 is normally pivoted upwardly, as seen in FIG. 3, so that an extension or lip plate hingedly connected to the front edge of the deck member will clear the rear end of the parked vehicle before it is pivoted outwardly to an extended position. Once the extension plate has assumed its extended position, the deck member and extension plate are lowered as a unit until the extension plate rests upon the top surface of the bed of the vehicle. As seen in FIG. 3, when the deck member 11 is in a raised position, the assembly 10 is disposed in an inoperative position, as will be described more fully hereinafter.

The assembly 10 is formed of but two components; a mounting bracket 12 and an elongated strip or piece 13 of a flexible, resilient, moisture-proof material. The bracket 12 is preferably metallic and includes an elongated inner wall section 14 which has a length substantially coextensive with the side edge portion 11b of the deck member 11. An elongated outer wall section 15 is also provided which is disposed in spaced face-to-face relation with wall section 14. The corresponding upper edge portions of the wall sections are interconnected by a bridge section 16. The wall sections 14 and 15 and bridge section 16, coact to form an elongated pocket P which extends the entire length of the bracket. One end of the pocket forms a first opening 17. The lower edge portions 14*a* and 15*a* of the wall sections 14 and 15 are spaced from one another and edge portion 14*a* is offset outwardly so as to subtend edge portion 15*a*. Edge portions 14*a*, 15*a* coact to form an elongated, narrow, second opening 18. One end of opening 18 terminates at first opening 17, see FIG. 5. The bracket is preferably of one-piece construction and is secured by welding or the like to the side edge portion 11*b* of the deck member and with the top of the bracket bridge section 16 flush with, or slightly below, the exposed surface 11*a* of the deck member. Thus, when the deck member 11 is disposed in position I, no portion of the bracket will project upwardly and interfere with the movement of traffic across the deck surface 11*a* or supporting surface D' of the loading dock.

In the illustrated embodiment the piece 13 has an L-shaped cross-sectional configuration, see FIG. 6, with the shorter leg, or first section 13*a* thereof of such a shape that it will fit within the bracket pocket P only upon the piece 13 being inserted endwise through the first opening 17 formed in the bracket, see FIG. 5. The longer leg, or second section, 13*b* of the piece extends outwardly from the pocket P through the second opening 18. The length of section 13*b* is substantially greater than the width of joint J, so that when member 11 is in position I, the section 13*b* will be bent upwardly by the side wall W and the distal edge 13*c* of the section will slidingly and resiliently engage the side wall W and form a seal therewith. The piece 13 is preferably formed of a suitable plastic material (e.g., PLYTEX) which retains its flexibility and resiliency when subjected to a wide range of temperature variations. Furthermore, the piece is imperforate and should be water and dirt resistant. Thus, when piece 13 is in sealing engagement with the side wall W, drafts and heat losses caused by the front of the pit being open, will be prevented. The back wall of the pit, not shown, and the back edge of the deck member, also not shown, may be provided with a suitable weatherseal. The latter weatherseal may constitute a mere strip of sealing material carried by the deck member back edge, which slidably and sealingly engages the pit back wall, when the deck member is in position I.

To facilitate insertion and removal of the section 13*a* with respect to the bracket pocket P, the section 13*a* may be made substantially stiffer than section 13*b*. The increased stiffness of the piece section 13*a* may be obtained by either embedding a stiffner element therein; increasing the relative thickness thereof and preforming the section with a slight elongated bow therein (see FIG. 6); including an additive to the formula of material forming same; or heating or otherwise treating the material of the piece section 13*a* differently from that of section 13*b*. The piece is preferably of unitary construction and is extruded to the desired shape.

The configuration and relative location of the second opening 18 formed in bracket 12 causes the piece section 13*a* to be impassable with respect thereto. Thus, the entry or exit of the section 13*a* with respect to the bracket pocket P is only through the first opening 17. It is preferred that opening 17 be disposed adjacent the front edge of the deck member 11 thereby facilitating positioning of the piece relative to the pocket when the deck member 11 is in a raised position as seen in FIG. 3. It is important to note that replacement of the piece 13 can be readily accomplished without the need for any tools.

In prior structures utilizing a piece similar to that of piece 13, it was customary to secure the piece by means of a plurality of longitudinally spaced screws or similar fasteners which necessitated suitable holes to be formed in the piece to receive the screw shanks. Not only did the holes significantly weaken the piece causing same to readily fracture or tear, but also required tools to tighten or loosen such screws. Oftentimes by reason of corrosion, rust, etc. the screws became frozen in place, necessitating a hack saw or other cutting tool to be used. Thus, such an operation required an inordinate amount of time and effort.

If desired, the bracket 12 may be affixed to the side wall W rather than to the deck member, in which case the distal edge 13*c* of section 13*b* will sealingly engage the side edge portion 11*b* of the deck member when the latter is pivoted downwardly into position I.

While the weather-sealing assembly has been described and illustrated with regard to a dock leveler, it is not intended to be limited thereto, but may be utilized in numerous other installations where an effective joint seal is required between a pair of members, one of which is relatively movable. Thus, it will be noted that the assembly embodies a minimum number of components; is of simple, yet sturdy, construction; and the replacement of one of the components can be readily accomplished without the need for tools and with the expenditure of a minimum amount of manual effort.

I claim:

1. An assembly for weather-sealing an elongated joint formed between a first member and a second member when said members assume a predetermined relative position, one of the members being relatively movable in a plane substantially parallel to the joint and transversely of the other member, said assembly comprising an elongated piece having an elongated first section and an elongated resilient flexible second section extending angularly from said first section; and an elongated bracket removably accommodating said piece, said bracket including an elongated inner wall section adapted to be fixedly secured to a side of one of the members defining the joint, an elongated outer wall section disposed in spaced substantially face-to-face relation with said inner wall section, and an elongated bridge section interconnecting a pair of corresponding first elongated edge portions of said wall sections, said inner and outer wall sections and said bridge section coacting to form an elongated pocket having a first opening at one end, corresponding second elongated edge portions of said wall sections being in spaced relation and forming an elongated narrow second opening, one end of said second opening terminaing at said first opening; the elongated first section of said elongated piece being disposed within the pocket of said bracket and the elongated second section of said elongated piece extending outwardly from said pocket through said second opening, said piece second section being adapted to span the joint and resiliently and sealingly engage the side of the other member defining the joint when the members assume the predetermined position, said piece first section being inserted into and removed from said pocket only through said first opening.

2. The assembly of claim 1 wherein the first and second sections of said elongated piece normally assume a preset angular relation; said piece first section being substantially impassable with respect to said second opening when said first section is disposed within said pocket.

3. The assembly of claim 1 wherein the elongated piece and the bracket are substantially coextensive with one another.

4. The assembly of claim 1 wherein the second elongated edge portion of the inner wall section is offset outwardly and subtends in spaced relation the corresponding second elongated edge portion of the outer wall section.

5. An assembly in combination with a first member and a second member for weather-sealing an elongated joint formed between the members when the latter are in a predetermined relative position, one of the members being relatively movable in a plane substantially parallel to the joint and transversely of the other member, said assembly comprising an elongated piece having an elongated first section and an elongated resilient flexible second section extending angularly from an elongated edge of said first section; and an elongated bracket removably accommodating said piece and fixedly secured to a side of one of the members defining the joint, said bracket including an elongated inner wall section, an elongated outer wall section disposed in spaced, substantially face-to-face relation with said inner wall section, and an elongated bridge section interconnecting a pair of corresponding first elongated edge portions of said wall sections, said wall sections and said bridge section coacting to form an elongated pocket having a first opening at one end, corresponding second elongated edge portions of said wall sections being in spaced relation and forming an elongated narrow second opening having one end thereof terminating at said first opening, said piece first section being slidably disposed within said pocket and said piece second section extending outwardly from said pocket through said second opening and spanning the joint and resiliently and sealingly engaging the joint-defining side of the other member when said members are disposed in said predetermined relative position, said elongated piece being inserted into and removed from said pocket only upon endwise movement of the piece first section through said first opening.

6. The combination of claim 5 wherein the elongated piece and the elongated bracket are substantially coextensive with the joint-defining side of the member to which said bracket is fixedly secured.

7. The assembly of claim 1 wherein the elongated piece first section is substantially impassable with respect to said bracket second opening when said first section is disposed within said pocket.

* * * * *